US008475632B2

(12) United States Patent
Sun et al.

(10) Patent No.: US 8,475,632 B2
(45) Date of Patent: Jul. 2, 2013

(54) METHOD FOR RECYCLING CUTTING FLUID

(75) Inventors: Yu-Lung Sun, Kaohsiung (TW); Yung-Hao Liu, Yunlin (TW); Ming-Zhe Tsai, Kaohsiung (TW)

(73) Assignee: Hong Jing Environment Company, Kaohsiung (TW)

( * ) Notice: Subject to any disclaimer, the term of this patent is extended or adjusted under 35 U.S.C. 154(b) by 336 days.

(21) Appl. No.: 12/943,421

(22) Filed: Nov. 10, 2010

(65) Prior Publication Data

US 2012/0073952 A1 Mar. 29, 2012

(30) Foreign Application Priority Data

Sep. 29, 2010 (TW) ..... 99133041 A

(51) Int. Cl.

| | |
|---|---|
| ***B01D 1/00*** | (2006.01) |
| ***B01D 3/00*** | (2006.01) |
| ***C01B 33/021*** | (2006.01) |
| ***C01B 33/037*** | (2006.01) |

(52) U.S. Cl.
USPC ..... 203/98; 159/44; 159/47.1; 159/901; 423/349; 568/852; 203/1; 203/2

(58) Field of Classification Search
USPC ..... 159/44, 47.1, 901; 203/1, 2, 98; 423/349; 568/852
See application file for complete search history.

(56) References Cited

U.S. PATENT DOCUMENTS

| | | | | |
|---|---|---|---|---|
| 5,693,596 | A | 12/1997 | Kaburagi et al. | |
| 5,795,400 | A * | 8/1998 | Berger et al. | 134/10 |
| 6,821,437 | B1 | 11/2004 | Eisner et al. | |
| 6,932,855 | B2 | 8/2005 | Chang et al. | |
| 8,029,756 | B1 * | 10/2011 | Schumacher | 423/349 |
| 2010/0061913 | A1 * | 3/2010 | Hariharan et al. | 423/342 |

* cited by examiner

*Primary Examiner* — Virginia Manoharan
(74) *Attorney, Agent, or Firm* — Muncy, Geissler, Olds & Lowe, PLLC

(57) ABSTRACT

A method for recycling cutting fluid includes preparing and processing a cutting fluid of silicon including a silicon mixture and a cutting fluid at an anoxic circumstance of 150° C. to 350° C. in a container, to obtain a vaporized cutting fluid and a silicon slurry; and condensing the vaporized cutting fluid to obtain a recycling cutting fluid.

5 Claims, 1 Drawing Sheet

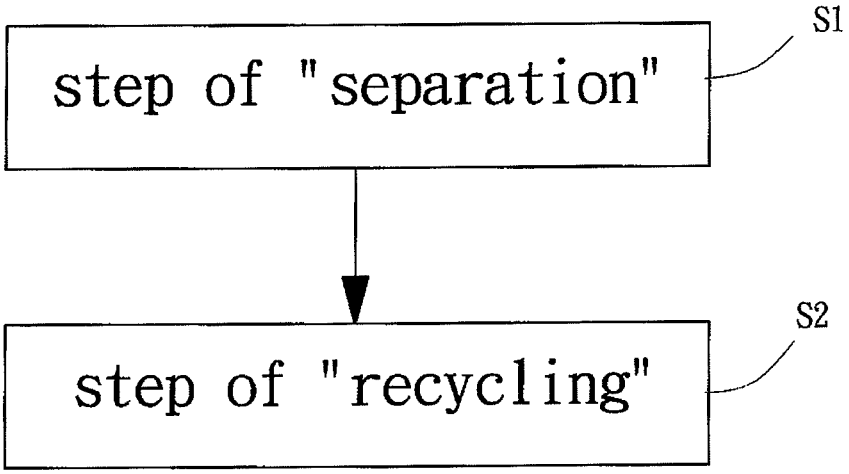
step of "separation"
S1
step of "recycling"
S2

METHOD FOR RECYCLING CUTTING FLUID

BACKGROUND OF THE INVENTION

1. Field of the Invention

The present invention relates to a recycling method, particularly to a method for recycling cutting fluid in the cutting industry of silicon wafer.

2. Description of the Related Art

Due to the fast development of the solar industry and the electronic industry, the requirement and performance of silicon chips is much more emphasized than ever. During the manufacture process of the silicon chip, a significant amount of wasted cutting fluid of silicon containing lots of debris from cutting tools and silicon bars may be generated, which may interfere with the quality of silicon chips if there is contamination of silicon oil.

Generally, silicon chips are obtained by continually cutting the silicon bar via a cutting tool, wherein the cutting tool generally consisting of carborundum is processed by providing a sustaining pressure to the silicon bar. During the cutting process, a cutting oil, mainly comprised of carborundum powders, polyethylene glycol (also called PEG), diethylene glycol (also called DEG) and cooling water, is used for regularly rinsing out the debris of cutting tool and silicon bar from the cutting tool. In this way, silicon chips with smooth cutting sections can be easily obtained. On the other hand, a great amount of wasted residue, such as cutting fluid of silicon, will be produced in the cutting process, which may lead to serious pollution if it is directly abandoned.

In the conventional art, the carborundum powders or silicon powders in the wasted cutting fluid of silicon can be recycled by separating the solid phase of the carborundum powders or silicon powders from the liquid phase of wasted fluid via a recycling method of centrifugal sedimentation. Otherwise, it is also sufficient to precipitate and isolate the colloid carborundum powder or silicon powder when adding a large amount of separating reagent to the wasted fluid.

However, there is no method for directly separating and recycling the cutting fluids from the wasted cutting fluid of silicon described above. Hence, it is necessary to provide a method for recycling cutting fluid.

SUMMARY OF THE INVENTION

The primary objective of this invention is to provide a method for recycling cutting fluid, which can be processed with a high recycling rate of cutting fluid.

The secondary objective of this invention is to provide a method for recycling cutting fluid, which can effectively separate the liquid phase of cutting fluid from the solid phase of carborundum powders and silicon powders.

A method for recycling cutting fluid comprises a step of "separation," by preparing and processing a cutting fluid of silicon including a silicon mixture and a cutting fluid at 150° C. to 350° C. in a container, to obtain a vaporized cutting fluid and a silicon slurry; and a step of "recycling," by condensing the vaporized cutting fluid to obtain a recycled cutting fluid.

Further scope of the applicability of the present invention will become apparent from the detailed description given hereinafter. However, it should be understood that the detailed description and specific examples, while indicating preferable embodiments of the invention, are given by way of illustration only, since various more will become apparent from this detailed description to those skilled in the art.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

SOLE FIGURE is a diagram illustrating the method for recycling cutting fluid of the present invention.

DETAILED DESCRIPTION OF THE INVENTION

Referring to FIG. 1, a method for recycling cutting fluid of the present invention comprises a step of "separation S1" and a step of "recycling S2".

In the step of "separation S1," a cutting fluid of silicon consisting of a silicon mixture and a cutting fluid is prepared and processed in an anoxic container with 150° C. to 350° C. for 1 to 4 hours until the cutting fluid is vaporized to obtain a vaporized cutting fluid and silicon slurry. Precisely, the cutting fluid of silicon is obtained from a cutting process of silicon wafer, wherein the cutting fluid of silicon comprises carborundum powders, silicon powders and impurities from other cutting processes, for example iron or metal debris from cutting tools. The cutting fluid of the present invention can be either in the form of diethylene glycol (DEG) or polyethylene glycol (PEG).

In the preferable embodiment of the present invention, the cutting fluid of silicon is processed in a container of a cracking still, with an anoxic circumstance of 150° C. to 350° C. for 1 to 4 hours. In general, there is a high risk of developing an active air—(such as oxygen and nitrogen) induced explosion during the oxidation of the cutting fluid of silicon at 150° C. to 350° C. due to the similar temperature to the flash point of DEG (150° C.) or PEG (200° C. to 230° C.). Hence, the oxidization of the cutting fluid of silicon has to be performed under the anoxic circumstance of the container in the present invention. Precisely, an air-extracting process is continually performed in the container of the cracking still for providing the anoxic circumstance of the present invention, wherein the internal pressure of the container is around −1 atm. As a result, the active air-induced explosion can be successfully avoided and the vaporized cutting fluid and silicon slurry can be obtained in the step of "separation S1".

In the step of "recycling S2," the vaporized cutting fluid is condensed to obtain the cutting fluid of the present invention. Precisely, the cutting fluid undergoes a process of condensation for cooling the vaporized cutting fluid to obtain a liquid phase of cutting fluid, wherein the cutting fluid is pure, without any contamination of carborundum powders, silicon powders and other debris. Therefore, the liquid phase of cutting fluid can be re-applied to the cutting process of silicon wafer.

In the preferable embodiment of the present invention, the vaporized cutting fluid is condensed via a process of water-cooling system or air-cooling system for completely separating and recycling the liquid phase of cutting fluid and the solid phase of silicon slurry.

Moreover, the silicon slurry can be further purified by removing the impurities and remaining cutting fluid to obtain the carborundum powders and silicon powders, which can also be re-used in the cutting process of silicon wafer.

To further prove the recycling efficiency of the method for recycling cutting fluid in the present invention, a cutting fluid of silicon containing 20% PEG or 20% DEG is prepared and undergone the process in the step of "separation" at different temperatures. During the process, the remaining rate and the recycling rate of PEG or DEG are monitored and recorded.

Referring to the Table 1, the recycling rate of PEG is higher than 95% when processed at 150° C. to 350° C., wherein a higher recycling rate of PEG is achieved according to a higher processing temperature. It is suggested that the method of the present invention for recycling cutting fluid is sufficient to recycle the cutting fluid efficiently from the cutting fluid of silicon containing 20% PEG; therefore, a maximum recycling rate of PEG, with about 99.5% can be obtained.

TABLE 1

Remaining rate and Recycling rate of PEG

| Groups | a | b | c | d | e | f |
|---|---|---|---|---|---|---|
| Temperature (° C.) | 100 | 150 | 200 | 250 | 300 | 350 |
| Remaining rate of PEG (g) | 45 | 10 | 7 | 2 | 2 | 1 |
| Recycling rate of PEG (%) | 77.5 | 95.0 | 96.5 | 99.0 | 99.0 | 99.5 |

Furthermore, referring to the Table 2, the recycling rate of DEG is approximately 97.6% and 98.8% while processed at 200° C. and 250° C. respectively. Hence, it is suggested that the method of the present invention for recycling cutting fluid is sufficient to recycle the cutting fluid efficiently from the cutting fluid of silicon containing 20% DEG, with significantly less amounts of DEG remaining. In this situation, the carborundum powders and silicon powders can be successfully and effectively recycled in the following process of the present invention.

TABLE 2

Remaining rate and Recycling rate of DEG

| Groups | g | h |
|---|---|---|
| Temperature (° C.) | 200 | 250 |
| Remaining rate of PEG (g) | 5 | 2 |
| Recycling rate of PEG (%) | 97.6 | 98.8 |

Through the present invention, the silicon mixture and the cutting fluid in the cutting fluid of silicon can be sufficiently separated, recycled and further apply to the cutting industry of silicon wafer. In the step of "separation S1," the cutting fluid of silicon is vaporized at an anoxic circumstance of 150° C. to 350° C., which allows the separation between the vaporized cutting fluid, the carborundum powders and silicon powders to be effectively and economically achieved, without adding any extra separating reagent. Additionally, in the step of "recycling S2," the vaporized cutting fluid can be easily condensed and recycled via a cooling system for re-using in the cutting industry of silicon wafer. Furthermore, the silicon powders and carborundum powders can also be recycled via another purified process, which makes the cutting industry of silicon wafer eco-friendly and frugal in material use.

Although the invention has been described in detail with reference to its presently preferred embodiment, it will be understood by one of ordinary skill in the art that various modifications can be made without departing from the spirit and the scope of the invention, as set forth in the appended claims.

What is claimed is:

1. A method for recycling cutting fluid, comprising:

preparing and oxidizing a cutting fluid of silicon including a silicon mixture and a cutting fluid at a temperature of 150° C. to 350° C. in a container, to obtain a vaporized cutting fluid and a silicon slurry, with said vaporized cutting fluid being separated from said silicon slurry;

condensing the vaporized cutting fluid to obtain a recycled cutting fluid; and recycling said cutting fluid.

2. The method for recycling cutting fluid as defined in claim 1, wherein the cutting fluid is polyethylene glycol or diethylene glycol.

3. The method for recycling cutting fluid as defined in claim 1, wherein the oxidizing is adjusted for 1 to 4 hours.

4. The method for recycling cutting fluid as defined in claim 1, wherein a pressure of the container is adjusted to −1 atm.

5. The method for recycling cutting fluid as defined in claim 1, wherein the vaporized cutting fluid is condensed by a cooling system to obtain a recycled cutting fluid.

* * * * *